United States Patent [19]

Beck

[11] Patent Number: 4,471,685

[45] Date of Patent: Sep. 18, 1984

[54] SYSTEM WITH SEQUENCED ACTIVATORS

[75] Inventor: Robert L. Beck, Seattle, Wash.

[73] Assignee: The Boeing Company, Seattle, Wash.

[21] Appl. No.: 419,086

[22] Filed: Sep. 16, 1982

Related U.S. Application Data

[62] Division of Ser. No. 225,252, Jan. 15, 1981, Pat. No. 4,437,387.

[51] Int. Cl.[3] ..... F15B 15/22; F15B 13/07

[52] U.S. Cl. ..... 91/189 R; 91/401; 91/437; 91/438

[58] Field of Search ..... 91/189 R, 189 A, 401, 91/438, 436, 437

[56] References Cited

U.S. PATENT DOCUMENTS

| | | | |
|---|---|---|---|
| 2,148,616 | 2/1939 | Gruber | 91/189 A |
| 3,141,382 | 7/1964 | Oldfield et al. | 91/189 A |
| 3;240,008 | 3/1966 | McMullen | 91/189 R |

*Primary Examiner*—Paul E. Maslousky

*Attorney, Agent, or Firm*—Delbert J. Barnard; Joan H. Pauly

[57] ABSTRACT

Fluid introduced into an actuator moves the piston, against the force of a return spring, to extend the actuator. After the actuator has extended a sufficient amount to perform its intended function, the piston contacts and moves a sleeve type closure for an outlet port. The additional extension of the actuator moves the sleeve to open the outlet port. This allows fluid from the source to flow through the actuator and out through the outlet port to an expansible chamber in a second actuator. In a preferred system, the second actuator is also a single acting linear motor and it includes a return spring. At the conclusion of the function of both actuators, a bypass valve in a return line is opened to allow fluid to flow out from the expansible chambers of both actuators back to a reservoir. The fluid from the second actuator flows back to the outlet port of the first actuator and from such port through a passageway which connects such port with the inlet-outlet port of the first actuator. A check valve in such passageway permits such flow, but prevents flow in the opposite direction.

15 Claims, 4 Drawing Figures

SYSTEM WITH SEQUENCED ACTIVATORS

This is a division of applicant's copending application Ser. No. 225,252 filed Jan. 15, 1981, now U.S. Pat. No. 4,437,387, and entitled Integral Actuator and Sequencing Valve.

DESCRIPTION

1. Technical Field

The present invention relates to linear fluid motors, and more particularly to the provision of such a motor in a system in which a sequencing valve is built into the motor and is positioned to be opened by the piston during the latter part of its travel through the motor from a retracted to an extended position, to provide communication with a second such motor.

2. Background Art

Various installations in which a plurality of linear fluid motors or actuators are operated in sequence are disclosed by the following U.S. Pat. Nos.: 1,905,065, granted Apr. 25, 1933, to Bernhard Scholl; 2,351,284, granted June 13, 1944, to John W. Overbeke; 2,394,655, granted Feb. 12, 1946, to Francis J. Better; 2,452,787, granted Nov. 2, 1948, to Arthur C. Patch; 2,462,580, granted Feb. 22, 1949, to Cyril D. Watson; 2,552,843, granted May 15, 1951, to John R. Clifton and Stanley R. Parker; 2,578,727, granted Dec. 18, 1951, to George W. Mork; 2,607,197, granted Aug. 19, 1952, to George S. Johnson; 3,146,678, granted Sept. 1, 1964, to Rudolf P. Strick; and 3,490,338, granted Jan. 20, 1970, to Donald M. Faust and Thomas E. Dixon. A problem with each of the actuators disclosed by these patents is that they are all relatively complex and in most cases heavy.

DISCLOSURE OF THE INVENTION

A basic object of the present invention is to provide a relatively simple and lightweight actuator with built-in sequencing valve which provides a positive mechanical sequencing in one simple unit, eliminating the need for a separate sequencing valve with added complexity and weight.

In its basic make-up, the integral actuator and sequencing valve device of the present invention comprises an elongated housing having first and second end walls and sidewall means defining a chamber within the housing which has a first diameter portion, extending axially inwardly from the first end wall, and a second and larger diameter portion extending axially inwardly from the second end wall. A shoulder is defined at a mid-portion of the chamber where the two different diameter portions of the chamber meet.

A piston within the chamber includes a head portion which is adapted to slide within the first diameter portion of the chamber and a piston rod which is connected to the piston head and extends therefrom towards the second end of the housing, and out through an opening in the second end of the housing.

Fluid is introduced into the chamber through an inlet port communicating with the chamber closely adjacent the first end wall of the housing. Such fluid moves the piston and in the process compresses a return spring which biases the piston towards a retracted position. Initially the piston moves by itself until it has been extended a sufficient amount to perform a designated function, e.g. operate a door actuator lock. Then, the piston contacts and moves with it a sleeve which is biased by another spring into a position closing an outlet port. When the piston reaches the end of its extend stroke the sleeve is in an outlet port opening position, allowing fluid to flow through the actuator and out through the outlet port to a second actuator.

According to an aspect of the invention, when pressure into the actuator is removed, the fluid in the second actuator will flow back to the first actuator, into the outlet port and then through a passageway which connects the outlet port with the inlet port. This passageway includes a check valve which permits flow from the outlet port to the inlet port, but not in the reverse direction.

These and further objects, advantages and features of the actuator, and a system utilizing such actuator, will be apparent from the description of the preferred embodiment which follows.

BEST MODES FOR CARRYING OUT THE INVENTION

Figure 1:
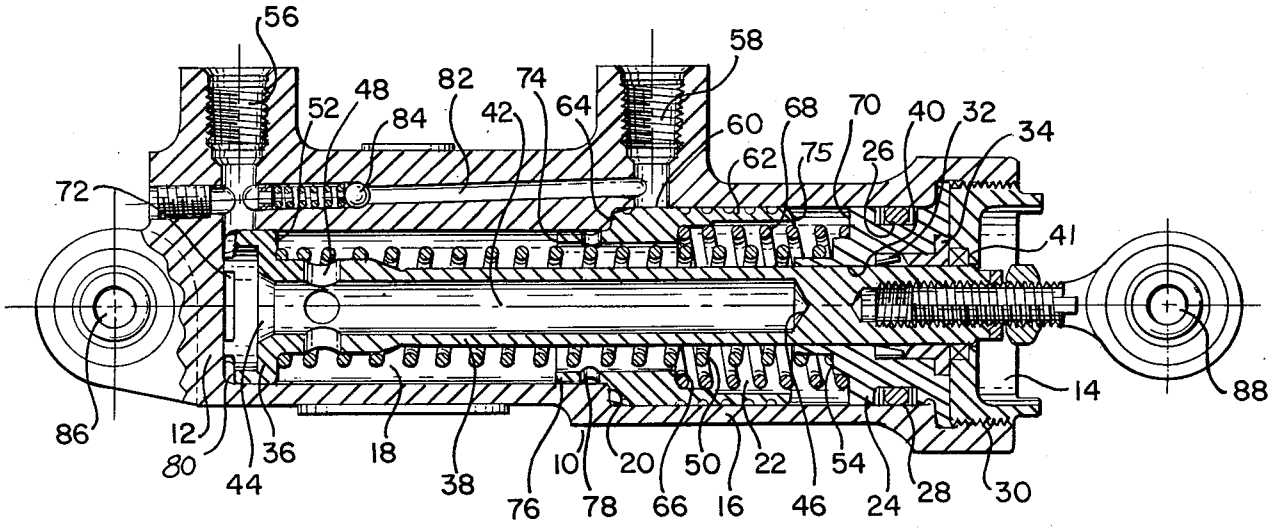
FIG. 1 is an axial section view of an integral actuator and sequencing valve constructed in accordance with the present invention, showing the piston fully retracted.

The embodiment of the actuator shown by FIG. 1 comprises an elongated housing 10 having a first end wall 12, a second end wall 14 and a sidewall means 16, together defining a chamber within the housing 10 which includes a first end portion 18 of a first diameter, extending axially of the housing from the first end wall 12 to a shoulder 20, and a second diameter portion 22 which extends axially of the housing from the second end wall 14 to the shoulder 20.

In preferred form, the second wall of the chamber is defined by inner end surface portions of a gland 24 which includes a circumferential groove 26 between its ends in which a static seal 28 is received. The end wall 12 is an integral part of the sidewall means 16 and the end wall 14 is removable. For this purpose, a threaded connection is provided at 30. A dynamic seal 32 is backed up by a seal retainer 34 against which the end wall 14 bears.

The piston portion of the actuator includes a piston head 36 which is slidably received within the smaller diameter portion 18 of the chamber. A piston rod 38, formed integrally with the piston head 36, extends from the piston head 36 towards the second end wall 14, and through aligned openings 40, 41, provided in the gland 24 and the end wall 14, respectively. A dynamic seal 32 provides a seal between the gland 24 and the outer surface of the piston rod 38.

The piston is formed to include a blind cavity 42 having an open end portion 44 and a closed end 46. A plurality of radial ports 48 (e.g. four) extend from the interior of cavity 42 out to the chamber space surrounding the piston shaft 38.

In preferred form, the actuator is a single acting fluid motor and it includes a piston return spring 50 which concentrically surrounds the piston rod 38 and at one end makes abutting contact with the rod side 52 of the piston head 36 and at its opposite end makes similar abutting contact with a radial surface portion 54 of the gland 24.

The actuator 10 is provided at its first end with a combined inlet port 56 and between its ends with an outlet port 58, provided as a result of the sequencing function of the apparatus. The inboard end of outlet port 58 is affronted by, and is blocked off or closed by, a sidewall portion 60 of an axially elongated sleeve 62. In this embodiment, the sleeve includes a radially outwardly directed shoulder 64, provided to make abutting engagement with the shoulder 20, and an inwardly directed shoulder 66 which makes abutting contact with one end of a spring 68. The second end of the spring 68 makes abutting contact with another radial surface 70 on the gland 24. Spring 68 normally biases the sleeve 62 axially inwardly, placing its shoulder 64 into abutting contact with the shoulder 20 formed where the two different diameter portions 18, 22 meet. When the sleeve is in this position the closure portion 60 affronts the inboard end of outlet port 58, closing such port.

The sleeve 62 remains in this position until it is contacted by the piston head 52.

The return spring 50 normally biases the piston into its retracted position, shown by FIG. 1. A pressure fluid is introduced into inlet port 56 to extend the actuator. Such fluid flows through radial grooves 80 formed in the face of the piston head, into a cavity 72. Such fluid exerts a force between the inner surface of end wall 12 and the piston rod, causing the piston to move to the right (as pictured), and the piston rod 38 to extend out through the second end wall 14.

The piston moves by itself until the radial surface 52 on the rod side of the piston head 36 makes contact with an inner end portion 74 of the sleeve 62 which is positioned to be within the travel path of the piston head 36. In the preferred embodiment, the abutment 74 is an end surface on a cylindrical extension 76 of the sleeve 62 which extends from the region of shoulder 64 axially into the smaller diameter portion 18 of the chamber. After contact has been made between surfaces 52 and 74, the additional movement of the piston caused by introduction of additional fluid into the expanding chamber formed between the piston head 36 and end wall 12 will cause the movement of both the piston and the sleeve 62 to the right (as pictured), until such movement is arrested by contact being made between end surface 75 of sleeve 62 and gland surface 70. This is the fully extended position of the piston.

Figure 2:
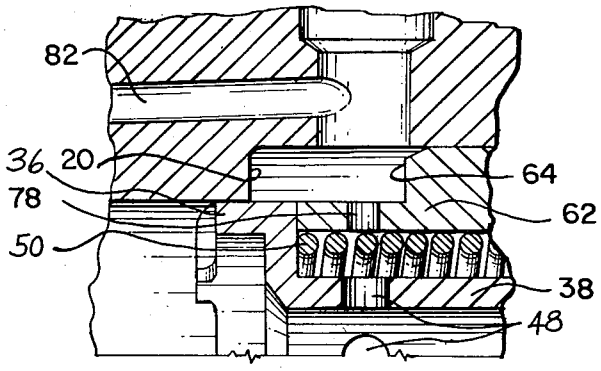
FIG. 2 is an enlarged scale fragmentary view of the inner end region of the outlet port, showing the positions which the piston head and the sleeve occupy when the piston is fully extended.

As shown by FIG. 2, when the piston is fully extended and the sleeve 62 is against the stop 70, the closure portion 60 of 62 is positioned to one side of the outlet port 58 and radial ports 78 in cylindrical extension 76 provide communication between the piston rod side of the chamber and the outlet port 58. Openings 80 in the piston head 36, and the aforementioned radial ports 48, communicate the chamber space on the face side of the piston head 36 with the chamber space on the rod side of the piston head 36. When the sleeve 62 is in its "open" position (FIG. 2), additional fluid delivered into the actuator through inlet-outlet port 56 will flow through the ports 80, 48, 78 to the outlet port 58.

In the preferred embodiment, the sidewall means of the housing is formed to include a rib which projects radially outwardly from the otherwise cylindrical outside shape of the actuator, axially between the two ports 56, 58. A longitudinal passageway 82 is formed in this rib, such as by drilling from the left (as pictured) end of the actuator towards outlet port 58, along a line which intersects both inlet-outlet port 56 and outlet port 58. A ball check valve 84 or the like is located within the left (as pictured) end of passageway 82, to prevent flow from port 56 to port 58, but permit flow from port 58 back to port 56.

Figure 3:
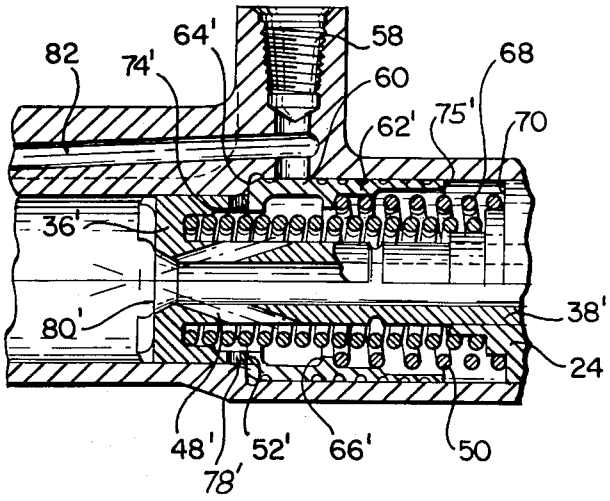
FIG. 3 is a fragmentary view of a mid-portion of a second form of actuator, showing a slightly different construction of the piston head and the sleeve, said view showing the piston in a partially extended position whereat the piston head first makes contact with an inner end portion of the sleeve.

FIG. 3 discloses a slightly modified form of piston and sleeve construction. In this embodiment the piston is shown partially extended, into a position in which its surface 52' has made contact with the end surface portion 74' at the inner end of sleeve 62'. When these elements are in the position shown the surface 64' on sleeve 62' is still against the shoulder 20. Also, the outlet port 58 is blocked by the closure portion 60 of sleeve 62', in the manner discussed above in connection the first embodiment.

In the embodiment shown by FIG. 3, radial ports 78' in a cylindrical extension of the piston head 36' replace the radial ports 78 in the cylindrical extension 76 of sleeve 62 in the first embodiment. As can be seen from an inspection of FIG. 3, additional movement of the piston to the right (as pictured), to place sleeve end surface 75' into contact with the stop surface 70 on the gland 24, will move closure portion 60 of sleeve 62' out of registry with outlet port 58, and will place the ports 78' into registry with outlet port 58. Actually, the ports 78' will communicate with an annular chamber that will be formed axially between radial surfaces 20 and 64', and radially between the outer diameter of piston head 36' and the inner diameter of chamber 22. It is this annular chamber which is in communication with the outlet port 58.

Figure 4:
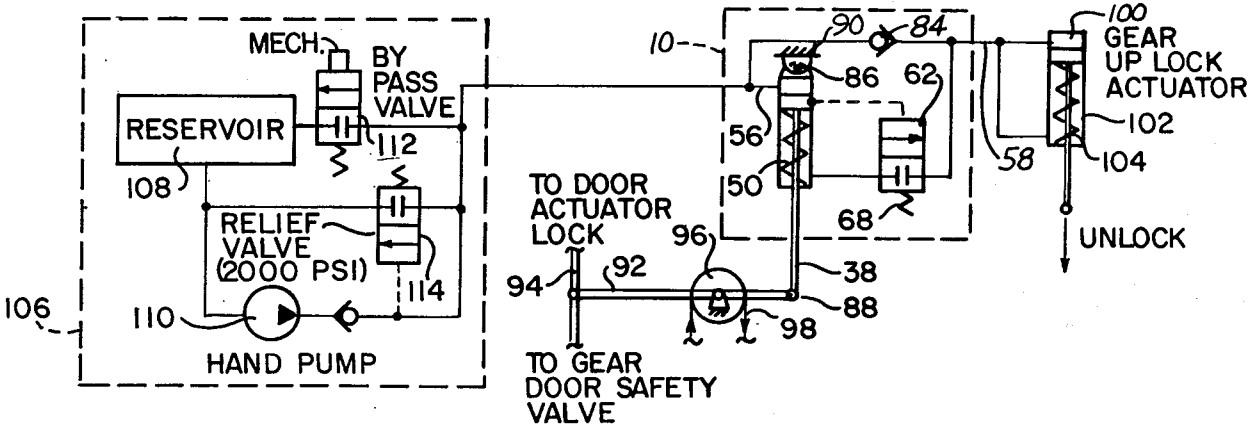
FIG. 4 is a schematic diagram of a system constructed in accordance with the invention, in which the actuator is in series with another actuator.

A use of the actuator will now be described. The actuator includes a mounting eye 86 at its closed end and a similar mounting eye 88 is provided at the outer end of the piston rod 38. Referring now to FIG. 4, the eye 86 is pivotally connected to a fixed support 90 and the eye 88 is pivotally connected to one end of a first class lever 92. The opposite end of lever 92 is pivotally connected to a door actuator lock. Beam 92 may be attached to a pulley 96 which carries a control line 98 for a door valve.

In the system shown by FIG. 4, the outlet port 58 of actuator 10 is delivered into an expansible chamber 100 of a second actuator 102. Actuator 102 is also a single acting linear motor and it includes a return spring 104.

The system shown by FIG. 4 is an alternate system and may include a hand pump system 106 for delivering the motive fluid from a reservoir 108 into the inlet-outlet 56 of actuator 10.

The system illustrated is an alternate gear extension system for an airplane. It includes a simple, independent hydraulic system 106 incorporating a hand pump 110, the reservoir 108, a bypass valve 112 and a relief valve 114. It also includes a lock release actuator at each gear door and up lock. The system is designed to provide a positive sequencing that will assure that the gear door actuator 10 will release first, allowing the door to open prior to release of the gear up lock, to in this manner preclude a gear hangup on the door during its freefall extension.

The actuator 10 was developed to provide mechanical sequencing. Pressure applied to the inlet port 56 of actuator 10 causes the actuator piston to extend. Flow to the outlet port 58 is blocked by the check valve 82 and the sleeve 62. Sleeve 62 blocks flow during piston extension only until the piston head strikes and moves the sleeve to allow flow first to and then out from the outlet port 58. Piston movement also fully unlocks the gear door lock, by operation of mechanisms 92, 94, prior to opening flow to the outlet port 58. The pressurization of gear up lock release actuator 102 can only occur subsequent to door release.

On activation of the bypass valve 112, to open a flow path from inlet port 56 back to the reservoir 108, the piston spring 50 restores the actuator 10 to its retract position and allows return flow from the chamber 100 of gear up lock actuator, through port 58 and passageway 82. Spring 104 returns gear up lock actuator 102 to its retracted position as fluid flows out from chamber 100.

The fact that neither actuator includes a return line results in a lower system weight, a reduction in seal losses, and an overall increase in system reliability. The springs make the actuators self-cocking.

The use of the integral sequence actuator (i.e. the integral actuator and sequencing valve) provides positive mechanical sequencing in one simple unit, eliminating the need for a separate sequencing valve with added complexity and weight.

The system concept of this invention could be adapted to release any separate door lock in sequence prior to operation of the door actuator itself.

As should be apparent, the system of this invention has general utility and may be used in any of a large number of installations requiring movement or operation of a first mechanism before a second mechanism is moved or operated.

From the foregoing, further variations, adaptations and modifications in systems utilizing fluid sequencing actuators can be evolved by those skilled in the art to which the invention is addressed, without departing from the invention as it is set forth in the following claims.

What is claimed is:

1. In a system, first and second actuators, said first actuator comprising:

an elongated housing including first and second end walls and sidewall means defining a chamber within said housing having a first diameter portion which extends axially inwardly of the housing from the first end wall to a mid-portion of the chamber, a second and larger diameter portion extending axially inwardly of the housing from the second end wall of the chamber to such mid-portion of the chamber, and a shoulder at the mid-portion of the chamber where the two different diameter portions of the chamber meet;

a piston within said chamber having a piston head adapted to slide within the first diameter portion of said chamber, a piston rod connected to the piston head and extending therefrom through the chamber and out through an opening in the second end of the housing, and passageway means in the piston communicating one side of the piston head with the other;

an inlet port communicating with said chamber closely adjacent the first end wall of the housing and a radial outlet port communicating with the chamber at a location axially between said shoulder and the second end wall of the housing;

a sleeve slidably received within the larger diameter portion of the chamber, said sleeve including a shoulder contacting inner end portion and a sidewall closure portion which extends across and blocks the outlet port when the sleeve is against the shoulder, and an inner end portion which is in the travel path of the piston head;

a sleeve biasing spring positioned to bias the sleeve towards and into contact with the shoulder;

a piston return spring positioned to bias the piston into a retracted position adjacent the first end wall;

wherein the piston head, the closure sleeve, and the chamber are dimensioned such that when the piston is retracted and pressure fluid is introduced into the chamber through the inlet port, such fluid will move the piston through the chamber until the piston head makes contact with the portion of the sleeve which is in the travel path of the piston head, and then further introduction of fluid will move both the piston and the sleeve together, until the piston has reached the end of its stroke and is fully extended;

wherein the closure portion of the sleeve is positioned away from the outlet port when the piston is fully extended and the outet port is in fluid receiving communication with the piston rod side of the piston head, whereby fluid communication is established through the chamber, from said inlet port to the outlet port;

said second actuator comprising a housing defining a chamber, a piston movable in the chamber, and an inlet port leading into said chamber on one side of the piston;

first conduit means interconnected between a source of fluid under pressure and the inlet of the first actuator; and second conduit means interconnected between the outlet of the first actuator and the inlet of the second actuator.

2. A system according to claim 1, wherein said sleeve includes a cylindrical portion at its shoulder end extending axially between the shoulder contacting inner end portion and the inner end portion of the sleeve which is in the travel path of the piston head, and said cylindrical wall portion includes radial openings therein which communicate the piston rod side of the chamber with the outlet port when the sleeve has been moved into its outlet port opening position by extension of the piston.

3. A system according to claim 1, wherein the piston head includes radial ports closely adjacent to where the piston head contacts the sleeve, and such ports communicate the piston rod side of the chamber with the outlet port when the sleeve has been moved into its outlet port opening position by extension of the piston.

4. A system according to claim 1, wherein the sleeve biasing spring is located within said chamber.

5. A system according to claim 1, wherein the piston return spring is located within said chamber.

6. A system according to claim 1, wherein the piston return spring is located within said chamber in said first actuator, concentric with the piston rod, and said sleeve biasing spring is also located within said chamber in said first actuator, concentric with the piston return spring.

7. A system according to claim 1, comprising third conduit means connected to the first conduit means and including a normally closed valve which when open will allow flow out from the first actuator back through the first conduit means and into the third conduit means.

8. A system according to claim 7, wherein the second actuator includes a return spring which normally biases the piston towards the inlet port for such actuator.

9. A system according to claim 1, further comprising passageway means in the first actuator communicating a portion of the outlet port that is located outside of the chamber with a portion of the inlet port which is located outside of such chamber, said passageway including check valve means permitting flow from the outlet port to the inlet port and preventing flow through said passageway from the inlet port to the outlet port.

10. A system according to claim 9, wherein said passageway means extends generally axially through the sidewall means of the housing.

11. A system according to claim 9, wherein said sleeve includes a cylindrical portion at its shoulder end extending axially between the shoulder contacting inner end portion and the inner end portion of the sleeve which is in the travel path of the piston head, and said cylindrical wall portion includes radial openings therein which communicate the piston rod side of the chamber with the outlet port when the sleeve has been moved into its outlet port opening position by extension of the piston.

12. A system according to claim 9, wherein the piston head includes generally radial ports closely adjacent to where the piston head contacts the sleeve, through which fluid flows from the chamber to the outlet port when the sleeve has been moved into its outlet port opening position by extension of the piston.

13. A system according to claim 9, wherein the sleeve biasing spring is located within said chamber in said first actuator.

14. A system according to claim 9, wherein the piston return spring is located within said chamber in said first actuator.

15. A system according to claim 9, wherein the piston return spring is located within said chamber in said first actuator, concentric with the piston rod, and said sleeve biasing spring is also located within said chamber in said first actuator, concentric with the piston return spring.

* * * * *

UNITED STATES PATENT AND TRADEMARK OFFICE

CERTIFICATE OF CORRECTION

PATENT NO. : 4,471,685

DATED : September 18, 1984

INVENTOR(S) : Robert L. Beck

It is certified that error appears in the above-identified patent and that said Letters Patent are hereby corrected as shown below:

Column 5, line 4, "82" should be --84--.

Column 5, line 17, --102-- should be added following "actuator".

Column 6, line 27, "outet" should be --outlet--.

Column 6, line 58, --in said first actuator-- should follow "chamber".

Column 6, line 60, --in said first actuator-- should follow "chamber".

Signed and Sealed this

*Twelfth* Day of *March 1985*

[SEAL]

*Attest:*

DONALD J. QUIGG

*Attesting Officer* *Acting Commissioner of Patents and Trademarks*